US008944305B2

(12) United States Patent
Sugie et al.

(10) Patent No.: US 8,944,305 B2
(45) Date of Patent: Feb. 3, 2015

(54) WEB CONVEYING APPARATUS AND WEB CONVEYING CONTROL METHOD

(75) Inventors: Yutaka Sugie, Toyota (JP); Masato Fukushima, Toyota (JP)

(73) Assignee: Toyota Jidosha Kabushiki Kaisha, Toyota-Shi (JP)

( * ) Notice: Subject to any disclaimer, the term of this patent is extended or adjusted under 35 U.S.C. 154(b) by 888 days.

(21) Appl. No.: 12/937,095

(22) PCT Filed: Apr. 9, 2009

(86) PCT No.: PCT/IB2009/005419

§ 371 (c)(1),
(2), (4) Date: Nov. 9, 2010

(87) PCT Pub. No.: WO2009/125298

PCT Pub. Date: Oct. 15, 2009

(65) Prior Publication Data

US 2011/0042437 A1 Feb. 24, 2011

(30) Foreign Application Priority Data

Apr. 10, 2008 (JP) ..... 2008-102132

(51) Int. Cl.
*B65H 23/038* (2006.01)
*B65H 23/04* (2006.01)

(52) U.S. Cl.
CPC ..... *B65H 23/038* (2013.01); *B65H 23/044* (2013.01); *B65H 2553/822* (2013.01)
USPC ..... 226/3; 226/21

(58) Field of Classification Search
CPC ..... B65H 23/0204; B65H 23/0208; B65H 23/0212; B65H 23/0216; B65H 23/038
USPC ..... 226/3, 15–23; 250/548, 559.01, 559.15, 250/559.24
See application file for complete search history.

(56) References Cited

U.S. PATENT DOCUMENTS

| | | | | |
|---|---|---|---|---|
| 3,039,483 | A | 6/1962 | Deering | |
| 3,090,534 | A | 5/1963 | Frommer et al. | |
| 3,330,456 | A | 7/1967 | Umstott | |
| 4,552,295 | A * | 11/1985 | Smith et al. | 226/180 |
| 4,641,070 | A | 2/1987 | Pfizenmaier et al. | |
| 4,888,717 | A * | 12/1989 | Ditto et al. | 700/302 |
| 4,891,528 | A | 1/1990 | Kuecker et al. | |

(Continued)

FOREIGN PATENT DOCUMENTS

| | | |
|---|---|---|
| DE | 22 52 490 A1 | 5/1974 |
| EP | 0 606 829 A2 | 7/1994 |

(Continued)

*Primary Examiner* — Sang Kim
*Assistant Examiner* — Scott Haugland
(74) *Attorney, Agent, or Firm* — Kenyon & Kenyon LLP

(57) ABSTRACT

A web conveying apparatus that conveys a web, includes: a transverse position displacement detection unit that detects a transverse position displacement of the web; a transverse position correction unit that corrects a transverse position of the web by a guide roller; width detection units that detect a width size in a left-right direction of the web; and a control unit that controls the transverse position correction unit in accordance with the transverse position displacement detected by the transverse position displacement detection unit and performs feedback control to position the web in a target position. The control unit changes a correction amount in the feedback control in accordance with the width size of the web detected by the width detection units.

6 Claims, 11 Drawing Sheets

(56) References Cited

U.S. PATENT DOCUMENTS

| | | | | | |
|---|---|---|---|---|---|
| 5,395,067 | A | * | 3/1995 | Kano et al. | 242/344 |
| 5,489,784 | A | | 2/1996 | Koiranen et al. | |
| 5,565,786 | A | * | 10/1996 | Balousek | 324/718 |
| 5,921,452 | A | * | 7/1999 | Wulf et al. | 226/21 |
| 6,164,201 | A | * | 12/2000 | Burke | 101/228 |
| 6,950,717 | B1 | * | 9/2005 | Pierce et al. | 700/136 |
| 2004/0074942 | A1 | * | 4/2004 | Sorebo et al. | 226/118.2 |
| 2004/0175213 | A1 | | 9/2004 | Matsuzuki et al. | |

FOREIGN PATENT DOCUMENTS

| | | | |
|---|---|---|---|
| EP | 1 288 150 | A2 | 3/2003 |
| EP | 1 637 877 | A1 | 3/2006 |
| JP | 58-202245 | | 11/1983 |
| JP | 63-127965 | A | 5/1988 |
| JP | 03-288757 | A | 12/1991 |
| JP | 06-239506 | A | 8/1994 |
| JP | 2000-038244 | A | 5/2000 |
| JP | 2001-226005 | A | 8/2001 |
| JP | 2002-137585 | A | 5/2002 |
| JP | 2004-074321 | A | 3/2004 |
| JP | 2005-206262 | A | 8/2005 |
| JP | 2006-264879 | A | 10/2006 |
| JP | 2007-326657 | A | 12/2007 |
| WO | 2007044252 | A2 | 4/2007 |

* cited by examiner

WEB CONVEYING APPARATUS AND WEB CONVEYING CONTROL METHOD

This is a 371 national phase application of PCT/IB2009/005419 filed 09 Apr. 2009, claiming priority of Japanese Patent Application No. 2008-102132 filed 10 Apr. 2008, the contents of which are incorporated herein by reference.

BACKGROUND OF THE INVENTION

1. Field of the Invention

The invention relates to a web that is a continuous material in the form of a flexible sheet, a web conveying apparatus, and a web conveying control method.

2. Description of the Related Art

A web that is a continuous material in the form of a flexible sheet, such as a plastic film, a metal film, and a continuous paper sheet is conveyed while being supported on a plurality of rollers. Cost reduction is required for a conveying apparatus that conveys such a web in order to increase productivity, and the increase in conveying speed, efficiency and accuracy are necessary.

A problem arising when a web is conveyed is that a transverse position of the web fluctuates and a wrinkle is formed due to misalignment of a guide roller, which is a roller for controlling the transverse position of the web, and free rollers provided upstream or, downstream of the guide roller, or because of disturbance fluctuations such as web tension or speed fluctuations. Accordingly, in a web conveying apparatus disclosed in Japanese Patent Application Publication No. 06-239506 (JP-A-06-239506), the formation of wrinkles is inhibited by detecting a web edge with an edge sensor or the like and controlling the transverse position of a web with good accuracy by using a guide roller.

However, with such a control of transverse position, because the guide roller is intentionally moved, it can cause misalignment of rollers. As a result, slackening or undulations occur in the width direction of the web, and in a case where such undulations are large, the formation of wrinkles cannot be sufficiently inhibited only by controlling the fluctuations of transverse positions For example, a conveying apparatus 90 of related art that is shown in FIG. 11 includes free rollers 95*a* and 95*b* that support and convey a web 20, a guide roller 93 provided between the free rollers 95*a* and 95*b*, an edge sensor 92 that detects a transverse position of the web 20, a control unit 91 that calculates a correction amount of the transverse position of the web 20, and a transverse position correction unit 94 that controls the guide roller 93 on the basis of the calculated transverse position correction amount. As shown in the figure, because the guide roller 93 is intentionally moved, the transverse position of the web 20 is controlled more than necessary. As a result, undulations can occur in the width direction of the web, and when the undulations are large, a wrinkle may be formed.

Furthermore, as the web conveying speed rises, the above-described transverse position control is actuated in a transient mode. In this case, the formation of wrinkles also cannot be sufficiently inhibited. Thus, in a case where a value detected by an edge sensor deviates greatly from the target value thereof, fluctuations of web position increase abruptly where such deviation is to be corrected, and the transverse position correction is actuated in a transient mode. Furthermore, even when the web position fluctuates gradually rather than abruptly, the transverse position correction is actuated in a transient mode because the web position itself fluctuates greatly. In a case where the control of transverse position is thus performed in a transient mode, the web can move, following the transverse position correction control, in the direction such that parallelism of the rolls can be greatly degraded and a wrinkle may be formed in the web.

Japanese Patent Application Publication No. 2007-326657 (JP-A-2007-326657) discloses a web conveying apparatus in which undulations, which indicate that a wrinkle may be formed, are detected with image analysis means on the basis of events such as the occurrence of undulations or slackening in the web width direction, prior to the formation of wrinkles in the web, and a guide roller is driven in the direction of canceling such undulations.

However, with the technology disclosed in JP-A-2007-326657, an expensive detection device such as image analysis means is used for detecting the undulations, and using such an image analysis means increases the equipment cost. Accordingly, a demand has been created for a technology that can effectively prevent the defects (wrinkles caused by the occurrence of waving) that can occur, while minimizing the increase in equipment cost.

Furthermore, a technology is needed that can detect a defect at a low cost when such a defect has occurred. Presently, as the number of inspection processes increases, the outflow of defects occurring in these processes unavoidably affects the entire equipment cost. Therefore, in order to prevent the outflow of defects from the processes themselves, it is necessary to prevent the formation of wrinkles in each process and also to, detect the wrinkles that have been formed and eliminate the defects in the processes themselves.

Furthermore, the web edge is not necessarily in the form of a straight line and can have high-frequency undulations due, for example, to burring occurring during slitting or because of curling occurring during rolling. A problem arising where web position correction control is executed with respect to a web having such undulations is that the undulations cause transient actuation in the transverse position control and the formation of wrinkles cannot be sufficiently inhibited.

SUMMARY OF THE INVENTION

The invention provides a web conveying apparatus and a web conveying control method that can prevent at a low cost the formation of wrinkles during conveying.

The first aspect of the invention relates to a web conveying apparatus that conveys a web, including: transverse position displacement detection means for detecting a transverse position displacement of the web; transverse position correction means for correcting a transverse position of the web by a guide roller; width detection means for detecting a width size in a left-right direction of the web; and control means for controlling the transverse position correction means in accordance with the transverse position displacement detected by the transverse position displacement detection means and performing feedback control to position the web in a target position, wherein the control means changes a correction amount in the feedback control in accordance with the width size of the web detected by the width detection means.

The control means may change by reduction the correction amount in the feedback control when the size of the web width detected by the width detection means is below a predetermined threshold.

The width detection means may be configured by two aforementioned transverse position displacement detection means provided at left and right edges of the web.

Free roller may be provided respectively upstream and downstream of the guide roller, and the width detection means may be provided on a side where one of the free rollers is nearer to the guide roller.

The second aspect of the invention relates to a web conveying apparatus that conveys a web, including: transverse position displacement detection means for detecting a transverse position displacement of the web; transverse position correction means for correcting a transverse position of the web by a guide roller; width detection means for detecting a width size in a left-right direction of the web; tension detection means for detecting a tension in a vicinity of left and right edges of the web; and control means for controlling the transverse position correction means in accordance with the transverse position displacement detected by the transverse position displacement detection means and performing feedback control to position the web in a target position, wherein the control means detects that a wrinkle has been formed in the web on the basis of the web width size detected by the width detection means and a tension difference in a vicinity of left and right edges of the web detected by the tension detection means.

The control means may detect the formation of a wrinkle in the web in a case where an amount of variation in the web width size detected by the width detection means is below a predetermined threshold and an amount of variation in a tension difference in a vicinity of left and right edges of the web detected by the tension detection means is below a predetermined threshold.

The width detection means is configured by two aforementioned transverse position displacement detection means provided at the left and right edges of the web.

The transverse position displacement detection means, the width detection means, and the tension detection means may be provided downstream of the guide roller.

The third aspect of the invention relates to a web conveying apparatus that conveys a web, including: width detection means for detecting a width size in a left-right direction of the web; and wrinkle detection means for detecting that a wrinkle has been formed in the web in a case where the web width size detected by the width detection means is below a predetermined threshold.

The width detection means may be provided between free rollers that are not involved in a processing process of processing the web or between free rollers immediately before a zone of unwinding after completion of the entire processing process. The width detection means may be provided between free rollers that are maintained parallel to each other.

The web conveying apparatus may further include transverse position displacement detection means for detecting a transverse position displacement of the web, and the width detection means may be configured by two aforementioned transverse position displacement detection means provided at the left and right edges of the web.

The fourth aspect of the invention, relates to a web conveying apparatus that conveys a web, including width detection means for detecting a width size in a left-right direction of the web; transverse position displacement detection means for detecting a transverse position displacement of the web; transverse position correction means for correcting a transverse position of the web by a guide roller; and control means for controlling the transverse position correction means in accordance with the transverse position displacement detected by the transverse position displacement detection means and performing feedback control to position the web in a target position, wherein the control means detects a high-frequency component contained in a signal indicating the web width size detected by the width detection means and calculates a signal indicating the transverse position displacement detected by the transverse position displacement detection means in a low-pass filter processing that removes the detected high-frequency component.

The width detection means may be provided between free rollers located after an unwinding zone of the web. The width detection means may be provided between free rollers that are maintained parallel to each other.

The width detection means may be configured by two transverse position displacement detection means provided at the left and right edges of the web.

The fifth aspect of the invention relates to a web conveying control method. The web conveying control method includes detecting a transverse position displacement of a web; detecting a width size in a left-right direction of the web; calculating a correction amount for feedback controlling so that the web is positioned in a target position in accordance with the detected transverse position displacement; and changing the correction amount in accordance with the detected web width size and executing the feedback control that shifts the web in a transverse direction by using a guide roller.

The correction amount may be changed by reduction in a case where the detected web width size is lower thane a predetermined threshold.

A width size in a left-right direction of the web may be detected by detecting a transverse position displacement of left and right edges of the web.

Free rollers may be provided respectively upstream and downstream of the guide roller, and the web width size may be detected on a side where one of the free rollers is nearer to the guide roller.

The sixth aspect of the invention relates to a web conveying control method. The web conveying control method includes detecting a width size in a left-right direction of a web; detecting a tension in a vicinity of left and right edges of the web; and detecting that a wrinkle has been formed in the web on the basis of the detected web width size and the detected tension difference in a vicinity of left and right edges of the web.

The formation of a wrinkle in the web may be detected in a case where an amount of variation in the detected web width size is below a predetermined threshold and an amount of variation in the detected tension difference in a vicinity of left and right edges of the web is below a predetermined threshold.

The width size in a left-right direction of the web may be detected by detecting a transverse position displacement of left and right edges of the web.

A width of the web may be detected and a tension in a vicinity of a left and right edges of the web may be detected downstream of the guide roller.

The seventh aspect of the invention relates to a web conveying control method. The web conveying control method includes detecting a width size in a left-right direction of a web, and detecting that a wrinkle has been formed in the web in a case where the detected web width size is below a predetermined threshold.

A width size of the web may be detected between free rollers that are not involved in a processing process of processing the web or between free rollers immediately before a zone of unwinding after completion of the entire processing process.

A width size of the web may be detected between free rollers that are maintained parallel to each other.

The eighth aspect of the invention relates to a web conveying control method. The web conveying control method includes detecting a width size in a left-right direction of the web; detecting a high-frequency component contained in a signal indicating the detected web width size; detecting a transverse position displacement of a web; calculating a signal indicating the detected transverse position displacement in a low-pass filter processing that removes the detected high-frequency component; and executing feedback control that shifts the web in a transverse direction by using a guide roller in accordance with the calculated transverse position displacement after the low-pass filter processing.

A width size of the web may be detected between free rollers located after an unwinding zone of the web.

A width size of the web may be detected between free rollers that are maintained parallel to each other.

A width size in a left-right direction of the web may be detected by detecting a transverse position displacement of left and right edges of the web.

With the web conveying apparatuses and web conveying control methods of various aspects of the invention, it is possible to provide a web conveying apparatus and a web conveying control method that can prevent at a low cost the formation of wrinkles during conveying. Furthermore, it is possible to provide a web conveying apparatus and a web conveying control method that can detect at a low cost the formation of wrinkles during conveying. Moreover, it is possible to provide a web conveying apparatus and a web conveying control method that can inhibit the formation of wrinkles during conveying by preventing at a low cost a transient movement of the web during conveying.

BRIEF DESCRIPTION OF THE DRAWINGS

The foregoing and further features and advantages of the invention will become apparent from the following description of example embodiments with reference to the accompanying drawings, wherein like numerals are used to represent like elements, and wherein.

DETAILED DESCRIPTION OF EMBODIMENTS

Figure 1:
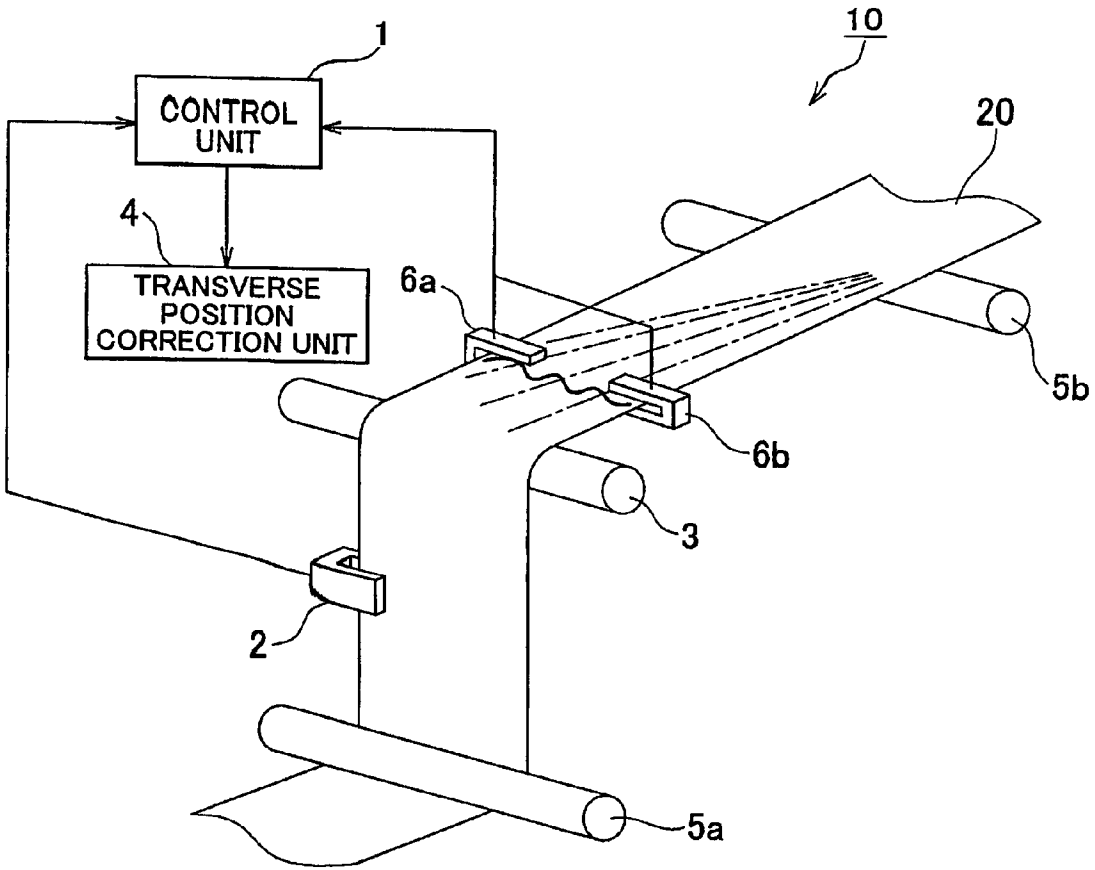
FIG. 1 illustrates the entire configuration of a web conveying apparatus of Embodiment 1 of the invention.

Embodiments of the invention will be described below in greater detail with reference to the appended drawings. To clarify the explanation, the description and drawings hereinbelow will be appropriately abbreviated and simplified. Structural elements and corresponding components having like configurations or functions will be denoted in the drawings by like reference symbols and explanation thereof will be omitted.

The configuration of a web conveying apparatus of Embodiment 1 will be explained below with reference to FIGS. 1 and 2. A web conveying apparatus 10 is an apparatus that conveys a web 20.

FIG. 1 is a perspective view illustrating the configuration of the web conveying apparatus of Embodiment 1. As shown in FIG. 1, the web conveying apparatus 10 has a control unit 1, an edge sensor 2, a guide roller 3, a transverse position correction device 4, free rollers 5*a* and 5*b*, and edge sensors 6*a* and 6*b*. The web conveying apparatus 10 can further include a plurality of rollers and roller drive means as members necessary to convey the web 20 (these members are not shown in FIG. 1).

The control unit 1 is a controller configured by a central processing unit (CPU), read only memory (ROM), random access memory (RAM), and the like. The control unit 1 inputs detection signals from the edge sensors 2, 6*a*, and 6*b* and controls the drive of conveying rollers (not shown in the figure) or controls the transverse position correction device 4 and controls the guide roller 3.

The control unit 1 has a function of drive controlling the position of the guide roller 3 with the transverse position correction device 4, thereby shifting the web 20 in the transverse direction, so that the web 20 is disposed in a desired transverse position, on the basis of transverse position information or transverse position displacement information of the web 20 detected by the edge sensor 2

In particular, the control unit 1 of Embodiment 1 has a function of calculating an absolute value of a width size in the left-right direction of the web 20 on the basis of detection signals of the edge sensors 6*a* and 6*b*, and acquiring information relating to the fluctuations of the transient web width size in accordance with the calculated width size of the web 20. The control unit 1 also has a function of adjusting the correction amount in transverse position control performed with the guide roller 3 on the basis of the fluctuation information on the transient web width size.

The edge sensor 2 functions as a transverse position displacement detection means for detecting the transverse position of the conveyed web 20 and outputting the detection signal to the control unit 1. The edge sensor 2 of Embodiment 1 is provided downstream of the guide roller 3 and detects the transverse position of the web 20 after the transverse position thereof has been controlled by the guide roller 3. In the configuration shown in FIG. 1, the edge sensor 2 is provided at one side edge of the web 20, but this configuration is not limiting and the edge sensors may be provided at both side edges.

Figure 2A:
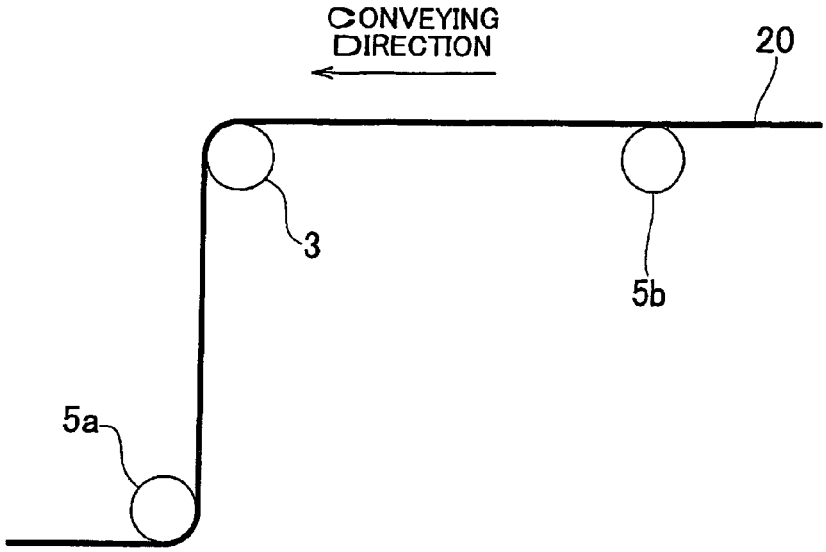
FIGS. 2A and 2B are a side view and a top, view of a principal portion of the web conveying apparatus of Embodiment 1 of the invention.
Figure 2B:
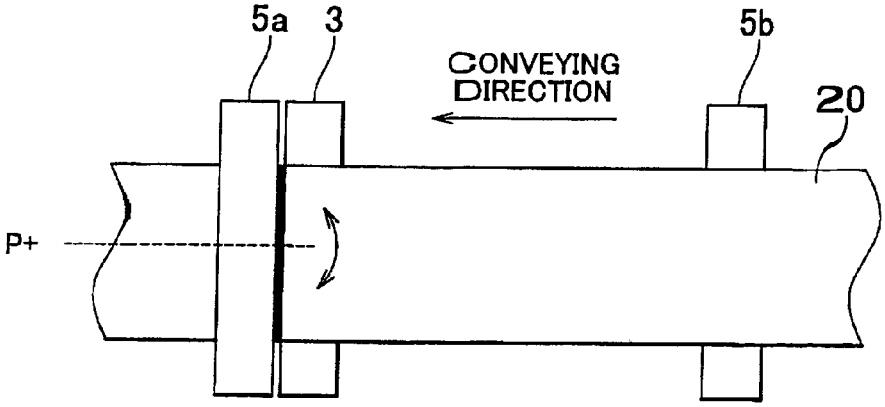

FIG. 2A is a side view illustrating the configuration of the web conveying apparatus of Embodiment 1. FIG. 2B is a top view illustrating the configuration of the web conveying apparatus of the embodiment. As shown in FIG. 2A, the free rollers 5*a* and 5*b* are provided downstream and upstream of the guide roller 3, respectively. The free rollers 5*a* and 5*b* are roller members that rotate in contact with the web 20.

As shown in FIG. 2A, the web 20 conveyed in the horizontal direction upstream of the guide roller 3 in Embodiment 1 is conveyed in the vertical direction downstream of the guide roller 3. Furthermore, as shown in FIG. 2B, the guide roller 3 is motion controlled by the transverse position correction device so that the guide roller can rotate about a P point. The guide roller 3 is a free roller that can rotate by itself.

The transverse position correction device 4 controls the position of the guide roller 3 and corrects the transverse position of the web 20 in response to a control signal of the control unit 1. The transverse position correction device 4 is configured, for example, by a shaft support member that supports the rotary shaft of the guide roller 3 and a drive mechanism that rotary drives the shaft support member by taking a horizontal plane as a rotation plane, the aforementioned components being disposed at both ends of the guide roller 3. Furthermore, the transverse position correction device 4 can be also realized by making one end of the guide roller 3 a fixed end and making the other end a movable end and controlling the position of the movable end with a microscrew or a piezoelectric element.

The edge sensors 6*a* and 6*b* function as width detection means that detect the transverse position of the conveyed web 20 and output the detection signals to the control unit 1. The control unit 1 can calculate the absolute value of the width in the left-right direction of the web 20 on the basis of the detection signals outputted by the edge sensors 6*a* and 6*b* provided at the left and right edges of the web. The edge sensors 6*a* and 6*b* of Embodiment 1 are provided upstream of the guide roller 3 and detect the width size of the web 20 before the transverse position thereof is controlled by the guide roller 3.

Figure 3:
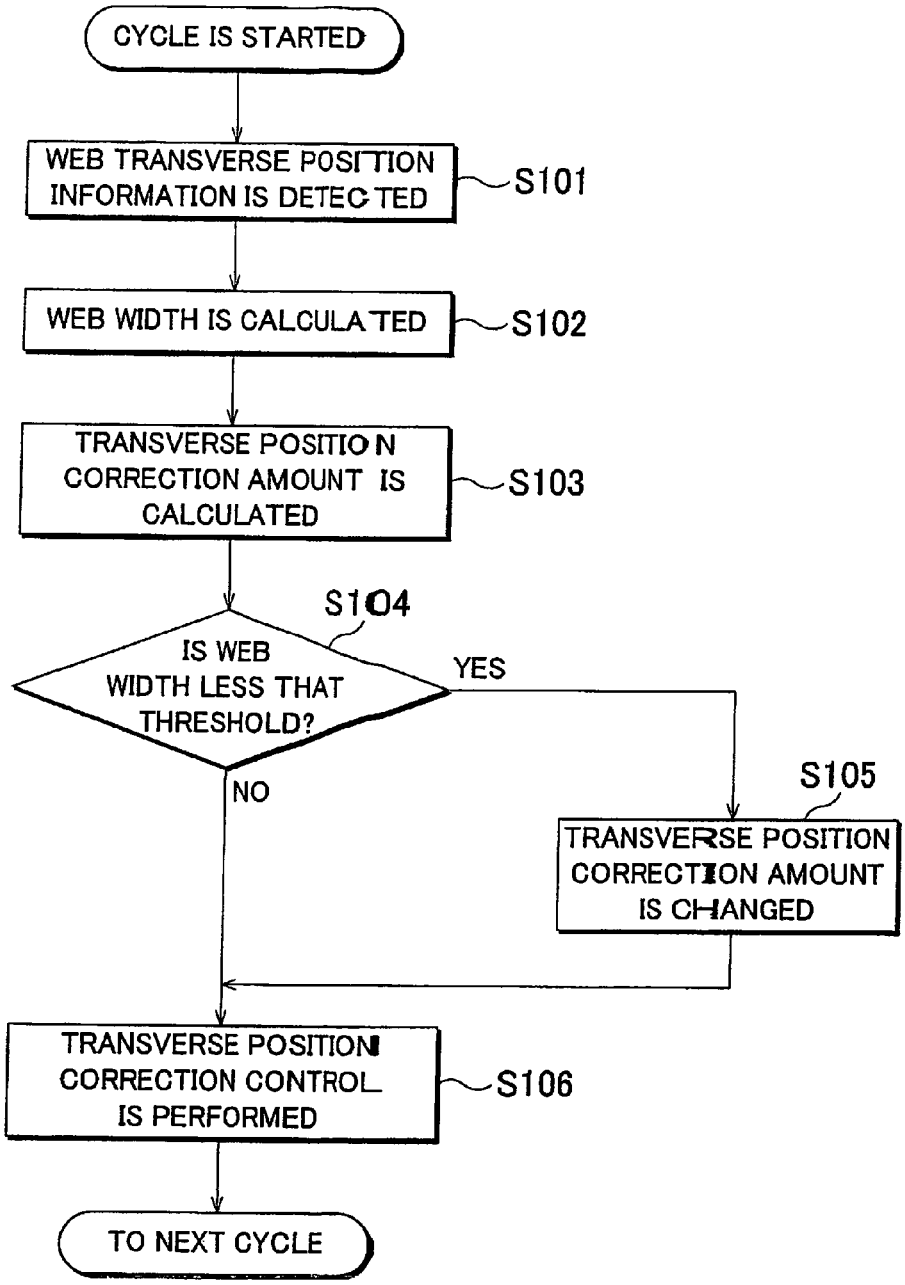
FIG. 3 is a flowchart illustrating the processing flow in a web conveying control method of Embodiment 1 of the invention.

A control method of the web conveying apparatus of Embodiment 1 will be described below with reference to FIG. 3.

The control unit 1 detects transverse position information of the conveyed web 20 with the edge sensor 2 and the edge sensors 6*a* and 6*b* (S101). Thus, the edge sensor 2 detects transverse position information of the web 20 after the transverse position thereof has been controlled by the guide roller 3, and the edge sensors 6*a* and 6*b* detect transverse position information in the left-right direction of the web 20 before the position thereof has been controlled by the guide roller 3. The control unit 1 inputs detection signals containing transverse position information detected by the edge sensors 6*a* and 6*h* and calculates and finds an absolute value of a width size in the left-right direction of the web 20 (referred to hereinbelow simply as "web width") on the basis of the detection signals (S102).

The control unit 1 then calculates a transverse shift amount (edge displacement) of the web 20 from a target position on the basis of the transverse position information of the web 20 detected by the edge sensor 2 and multiplies this edge displacement by a predetermined feedback gain, thereby calculating a target control amount of guide roller drive (for example, a target speed is calculated as the target control amount). The control unit 1 then calculates a guide roller correction amount as a transverse position correction amount necessary for realizing the calculated target control amount (S103).

The control unit 1 then determines whether the web width calculated in step S102 is lower than a predetermined threshold (S104). The predetermined threshold is set in advance in the control unit 1.

When the control unit 1 determines that the web width is below the predetermined threshold, the control unit reduces the correction amount of the guide roller drive calculated in step S103 (S105). Thus, when the web width has decreased so as to become less than the predetermined threshold, it is assumed that a wrinkles has been generated and the correction amount in the immediately preceding cycle is maintained without further increasing the correction amount of the guide roller drive. By contrast, when the control unit 1 determines that the web width is not below the predetermined threshold, that is, equal to or greater than the predetermined threshold, the control flow moves to S106.

The control unit 1 controls the transverse position correction device 4 on the basis of the correction amount calculated in step S103, or the correction amount modified in step S105, moves the guide roller 3, and corrects the transverse position of the web 20 (S106).

FIG. 4 is a schematic diagram illustrating how the control unit modifies the correction amount of guide roller drive in accordance with a web width.

Figure 4A:
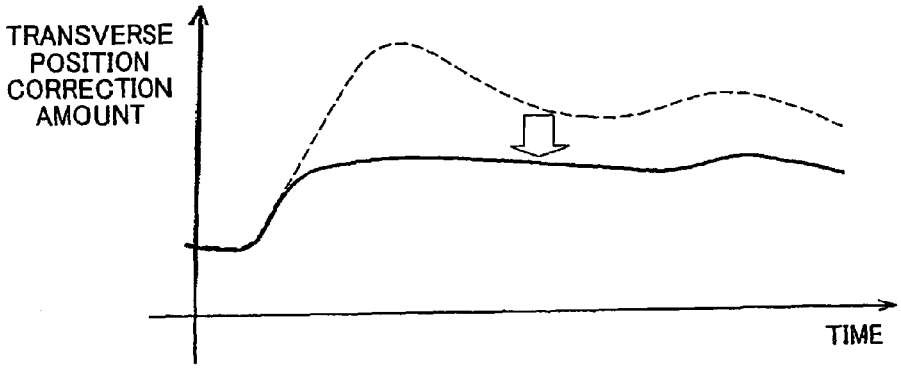
FIGS. 4A and 4B are schematic views illustrating a mode of web conveying control of Embodiment 1 of the invention.
Figure 4B:
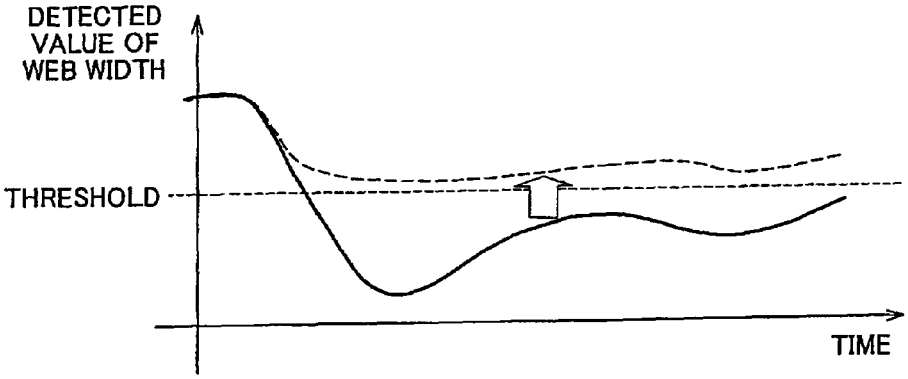

In the web conveying apparatus, the correction amount of guide roller drive is initially calculated, for example, as shown by a broken line in FIG. 4A, on the basis of the transverse position information detected by the edge sensor 2. In the web conveying apparatus of Embodiment 1, the correction amount of guide roller drive is modified in accordance with fluctuations of web width, and the transverse position of the web 20 is corrected based on the modified correction amount. In other words, the correction amount of guide roller drive is modified so that the web width does not become less than the predetermined threshold. Thus, as shown in FIG. 4B, size fluctuations of web width detected by the edge sensors 6*a* and 6*b* are detected at all times, and when the detected web, width is not less than the predetermined threshold (the detected web width is shown by a broken line in the figure), the correction amount of guide roller drive is not modified. By contrast, when the web width detected by the edge sensors 6*a* and 6*b* is less than the predetermined threshold (the detected web width is shown by a solid line in the figure), as shown in FIG. 4B, the correction amount of guide roller drive is modified so as not to be further increased. As a result when the detected web width has decreased to below the predetermined threshold, the correction amount of guide roller drive is restricted as shown in FIG. 4A (the restricted correction amount is shown in the figure by a solid line).

As described hereinabove, in the web conveying apparatus of Embodiment 1, the web width is detected during conveying and the correction amount of guide roller drive is modified when the detected web width is below the predetermined threshold. Because the web width decreases due to undulations generated in the web, the formation of wrinkles can be detected in advance by detecting the web width by the edge sensors 6*a* and 6*b*. Therefore, by detecting the web width by an inexpensive means such as the edge sensors 6*a* and 6*b* and restricting the correction amount so that the detected web width does not become less than the predetermined threshold, it is possible to prevent the formation of wrinkles during conveying of the web 20.

Figure 5:
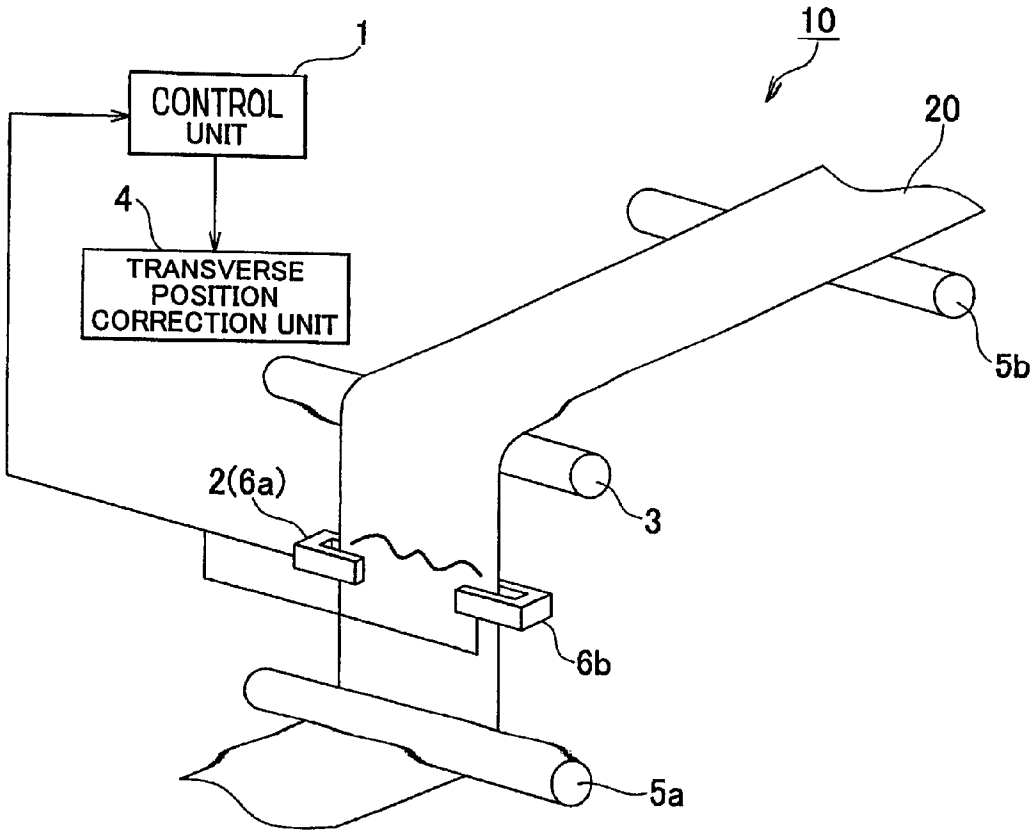
FIG. 5 illustrates another entire configuration of a web conveying apparatus of Embodiment 1 of the invention.

In Embodiment 1, an example is described in which the web width is detected by using edge sensors 6*a* and 6*b* provided upstream of the guide roller 3, but the invention is not limited to this configuration. Thus, the edge sensors 6*a* and 6*b* serving as width detection means may be provided on a side with a shorter distance from among the distance between the free roller 5*a* and the guide roller 3 and the distance between the free roller 5*b* and the guide roller 3. This is because undulations easily become larger when the distance between the guide roller 3 and the free rollers 5*a*, 5*b* is shorter and, therefore, by providing the edge sensors 6*a* and 6*b* on the side with the shorter distance between the guide roller 3 and the free roller, it is possible to detect more accurately the undulations generated in the web. Furthermore, when the edge sensors 6*a* and 6*b* are provided downstream of the guide roller 3, for example, as shown in FIG. 5, the aforementioned edge sensor 2 may be used as the edge sensor 6*a*. Moreover, the edge sensor that detects, the web width may be, provided only either upstream or downstream of the guide roller 3, or both downstream and upstream thereof.

Figure 6:
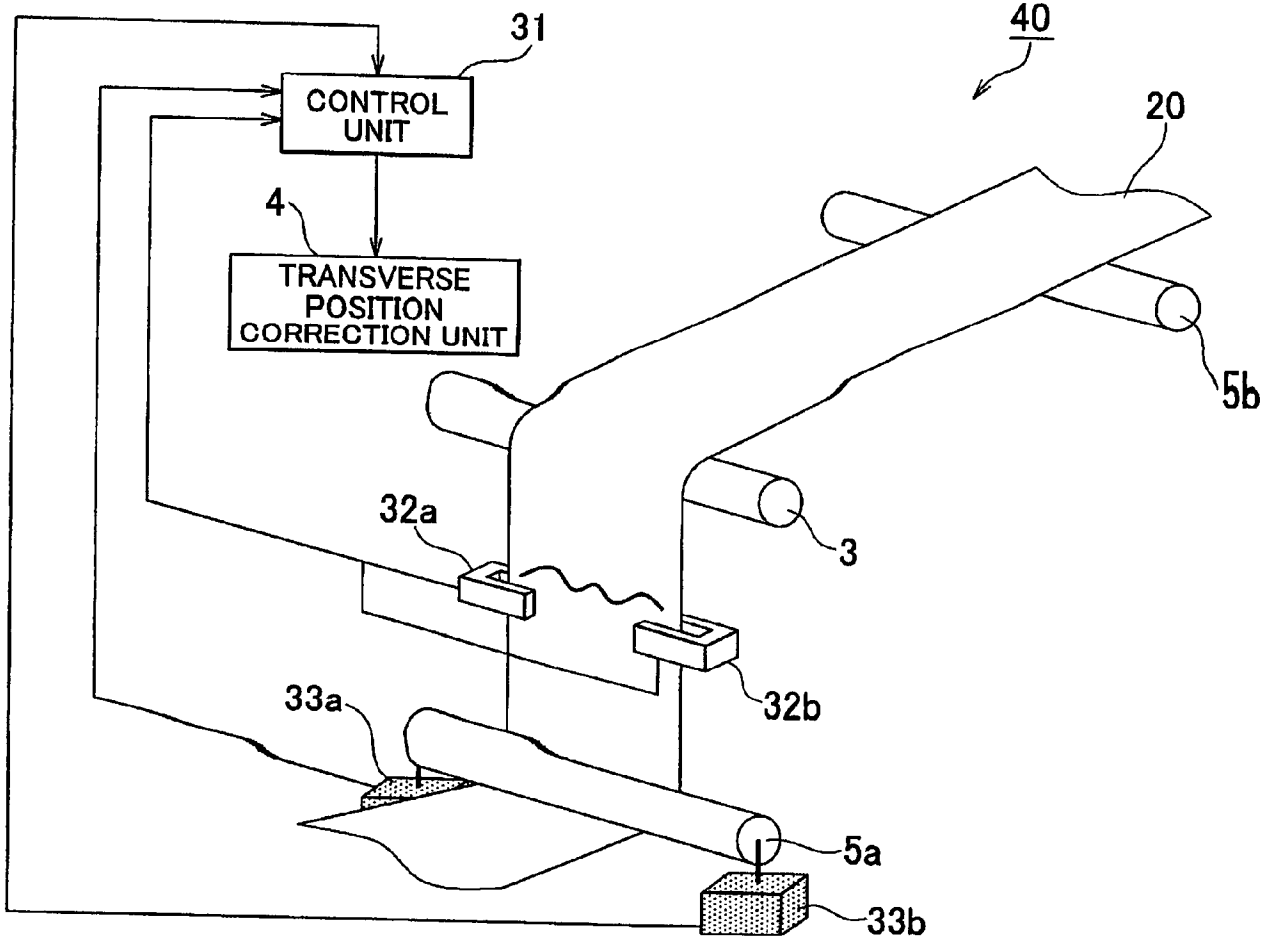
FIG. 6 illustrates the entire configuration of a web conveying apparatus of Embodiment 2 of the invention.

A configuration of the web conveying apparatus of Embodiment 2 of the invention will be described below with reference to FIG. 6. As shown in FIG. 6, a web conveying apparatus 40 has a control unit 31, edge sensors 32*a* and 32*b*, a guide roller 3, a transverse position correction device 4, free rollers 5*a* and 5*b*, and tension sensors 33*a* and 33*b*. Here, the edge sensors 32*a* and 32*b* and the tension sensors 33*a* and 33*b* may be provided downstream of the guide roller 3. The web conveying apparatus 40 further includes a plurality of rollers and roller drive means as members necessary to convey a web 20 (these members are not shown in FIG. 6). The guide roller 3, transverse position correction device 4, and free rollers 5*a* and 5*b* are structural elements and corresponding parts having configurations and functions identical to those described in Embodiment 1. Therefore, the explanation thereof is herein omitted.

The control unit 31 is a controller configured by a CPU, a ROM, a RAM, and the like. The control unit 31 inputs detection signals from the edge sensors 32*a* and 32*b* and the tension sensors 33*a* and 33*b*, controls the drive of conveying rollers (not shown in the figure) or controls the transverse position correction device 4 and controls the guide roller 3.

The control unit 31 has a function of drive controlling the position of the guide roller 3 with the transverse position correction device 4, thereby shifting the web 20 in the transverse direction, so that the web 20 is disposed in a desired transverse position, on the basis of transverse position information or transverse position displacement information of the web 20 detected by the edge sensor 32*a* or 32*b*.

In particular, the control unit 31 of Embodiment 2 has a function of calculating an absolute value of a width size in the left-right direction of the web 20 on the basis of detection signals of the edge sensors 32*a* and 32*b*, and acquiring information relating to the fluctuations of the transient web width size in accordance with the calculated width size of the web 20. The control unit 31 also has a function of calculating an absolute value of tension difference in the vicinity of the left and right edges of the web 20 and acquiring information relating to the transient tension difference on, the basis, of detection signals of the tension sensors 33*a* and 33*b*. The control unit 31 also has a function of detecting wrinkles generated in the web 20 on the basis of the fluctuation information, on the transient web width size and information on the transient tension difference.

The edge sensors 32*a* and 32*b* function as transverse position displacement detection means and width detection means for detecting the transverse position of the conveyed web 20 and outputting the detection signal to the control unit 31. The edge sensors 32*a* and 32*b* of Embodiment 2 are provided downstream of the guide roller 3 and detect the transverse position of the web 20 after the transverse position thereof has been controlled by the guide roller 3. The control unit 31 also calculates an absolute value of the width size in the left-right direction of the web 20 on the basis of detection signals outputted by the edge sensors 32*a* and 32*b* provided at the left and right edges of the web.

The tension sensors 33*a* and 33*b* are force sensors (tensiometers) hat support both ends of a rotary shaft of the free roller 5*a* and detect a force applied vertically upward to both ends of the free roller 5*a*, thereby detecting a tension applied in the vicinity of the left and right edges of the web 20. The control unit 31 can obtain information relating to a tension difference in the vicinity of the left and right edges of the web 20 on the basis of detection signals outputted by the tension sensors 33*a* and 33*b*. The free roller 5*a* is provided in a position in which the web 20 is biased downward from above.

FIG. 7 is a schematic diagram illustrating how the control unit detects wrinkles formed in the web in accordance with the web width and tension difference.

Figure 7A:
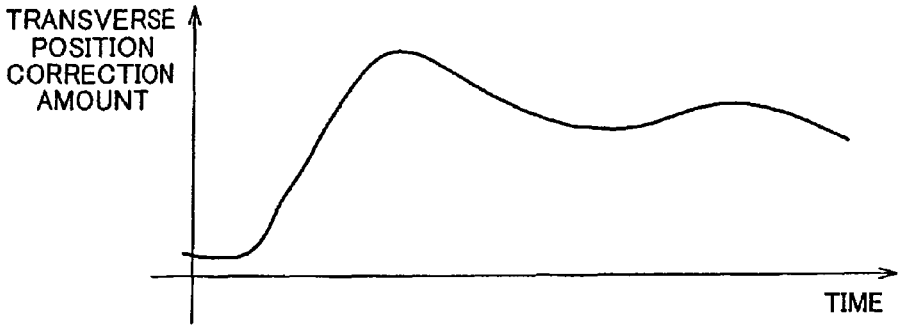
FIGS. 7A to 7C are schematic views illustrating a mode of web conveying control of Embodiment 2 of the invention.

A correction amount of guide roller drive is initially calculated (for example, the correction amount shown in FIG. 7A is calculated) on the basis of transverse position information detected by the edge sensor 32*a* (or edge sensor 32*b*), and the transverse position of the web 20 is corrected based on the corrected amount. The transverse position of the web 20 is corrected by the guide roller 3; a web width is detected by the edge sensors 32*a* and 32*b*, and a tension difference is detected by the tension sensors 33*a* and 33*b*.

Figure 7B:
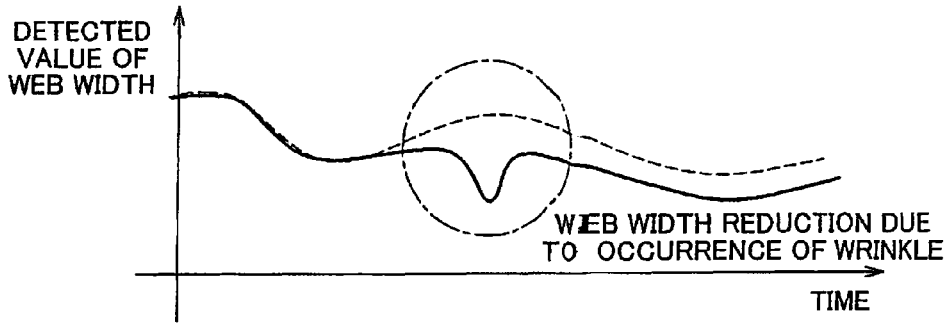
Figure 7C:
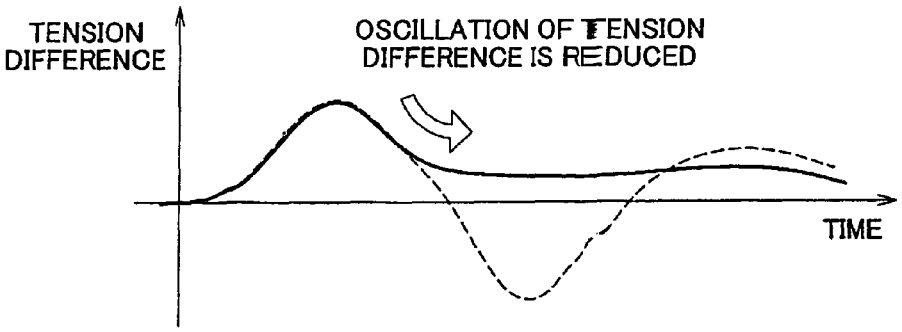

In a case where no wrinkle has been formed in the web 20 during transverse position correction of the web 20, the web width and tension difference are detected, for example, as shown by solid lines in FIGS. 7B and 7C, respectively. In case where no wrinkle has been formed in the web 20, as shown by broken lines in FIGS. 7B and 7C, the detected web width and tension difference oscillate continuously. By contrast in a case where a wrinkle has been formed in the web 20 during transverse position correction of the web 20, the oscillation pattern of the detected web width and tension difference varies as shown by solid lines in FIGS. 7B and 7C. Thus, in a case where a wrinkle has been formed in the web 20, the detected web width rapidly decreases as shown by a solid line in FIG. 7B (shown in a region surrounded by a dot-dash line in the figure). Furthermore, in a case where a wrinkle has been formed in the web 20, oscillations of the detected tension difference are attenuated as shown by a solid line in FIG. 7C (oscillations after the region surrounded by the dot-dash line in FIG. 7B). This is because the formation of wrinkles causes energy loss in the web 20, the tension acting upon the web 20 is absorbed by the generated wrinkle and oscillations of the tension difference are attenuated.

As explained hereinabove, in a case where a wrinkle has been formed, a web width decreases and when buckling (that is a wrinkle) occurs in the web 20, a tension difference can be considered acting as a force for buckling in the web 20. Therefore, by combining the web width and the fluctuations of tension difference, it is possible to discriminate between a case where the decrease in web width is caused by the formation of wrinkles and a case where it is caused by undulations. Thus, in the web conveying device of Embodiment 2, a web width and a tension difference during conveying are detected and a wrinkle generated in the web 20 is detected in accordance with fluctuations of the detected web width and tension difference, thereby making it possible to estimate that a wrinkle has been formed in a case where the web width has abruptly decreased and oscillations of the tension difference have attenuated. In other cases, it can be estimated that the decrease in web width is caused by waves. Therefore, it is possible to detect a web width and tension difference with inexpensive means such as an edge sensor and a tension sensor and detect that a wrinkle has been formed in the web 20 on the basis of detected fluctuations of the web width and tension difference.

The control unit 31 may detect that a wrinkle has been formed in the web 20 in a case where a variation amount of web width detected by the edge sensors 32*a* and 32*b* is below a predetermined threshold and also where a variation amount of tension difference detected by the tension sensors 33*a* and 33*b* is below a predetermined threshold. Here, the predetermined thresholds relating to the web width and tension difference are set in the control unit 31 in advance.

Figure 8:
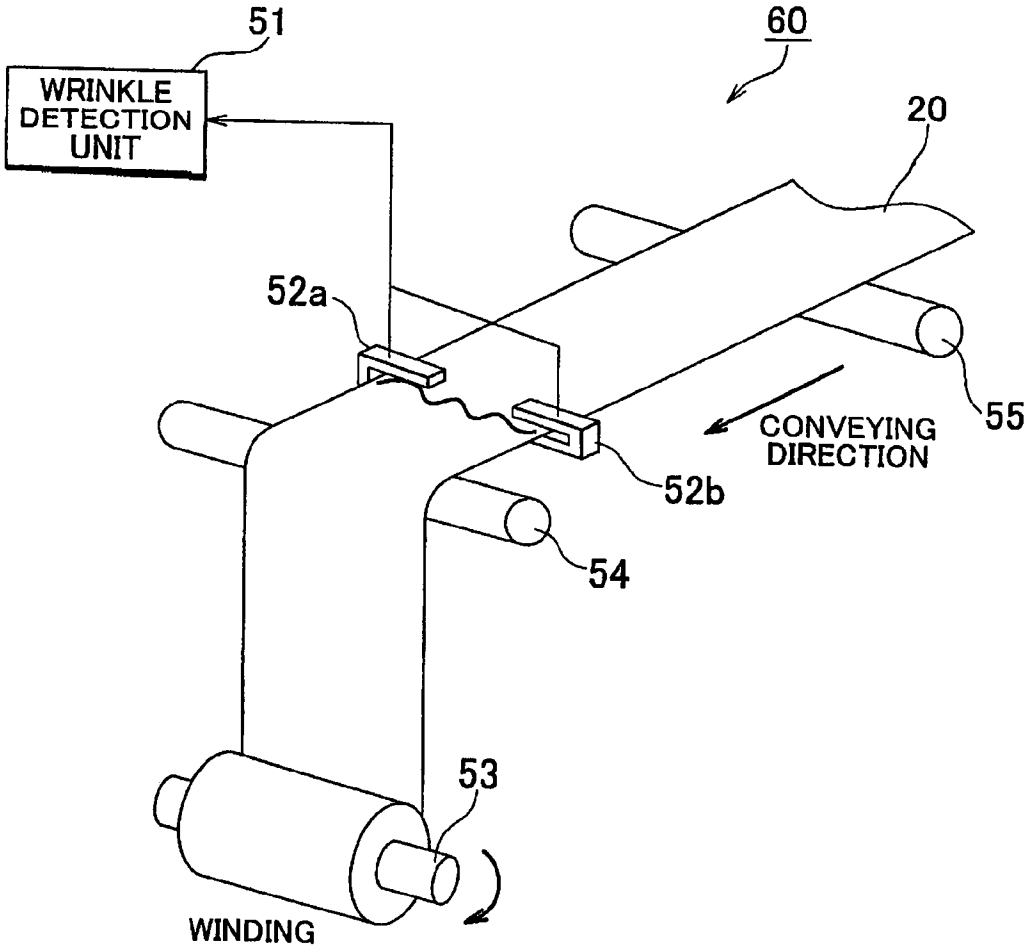
FIG. 8 illustrates the entire configuration of a web conveying apparatus of Embodiment 3 of the invention.

A configuration of the web conveying apparatus of Embodiment 3 of the invention will be, described below with reference to FIG. 8. As shown in FIG. 8, a web conveying apparatus 60 has a wrinkle detection device 51, edge sensors 52*a* and 52*b*, and free rollers 53, 54, and 55. The web conveying apparatus 60 further includes a plurality of rollers and roller drive means as members necessary to convey a web 20 (these members are not shown in FIG. 8).

The wrinkle detection device 51 is configured by a CPU, a ROM, a RAM, or the like. The wrinkle detection device 51 inputs detection signals from the edge sensors 52*a* and 52*b* and detects wrinkles generated in the web 20. The wrinkle detection device 51 of Embodiment 3 has a function of calculating an absolute value of a width size in the left-right direction of the web 20 on the basis of detection signals of the edge sensors 52*a* and 52*h*, and acquiring information relating to the fluctuations of the transient web width size in accordance with the calculated width size of the web 20. The wrinkle detection device 51 also has a function of detecting wrinkles generated in the web 20 on the basis of the fluctuation information on the transient web width size.

The edge sensors 52*a* and 52*b* function as width detection means for detecting the transverse position of the conveyed web 20 and outputting the detection signal to the wrinkle detection device 51. The edge sensors 52*a* and 52*b* of Embodiment 3 are provided between the free roller 54 and the free roller 55 and detect the transverse position of the web 20 after the transverse position thereof has been controlled by the guide roller 3. The wrinkle detection device 51 also calculates an absolute value of the width size in the left-right direction of the web 20 on the basis of detection signals outputted by the edge sensors 52*a* and 52*b* provided at the left and right edges of the web.

The edge sensors 52*a* and 52*b* are preferably provided between free rollers that are not involved in the processing process and that are completely free of misalignment. For example, the edge sensors 52*a* and 52*b* are provided between free rollers provided immediately after a zone where the processing process has been completed or between free rollers provided immediately before a zone where the web subjected to the entire processing process is wound (in the example shown in FIG. 8, the free rollers 54 and 55 are provided immediately before the zone where the web 20 is wound by the free roller 53). Furthermore, the free rollers are disposed so as to be maintained parallel to each other. Thus, it is preferred that the edge sensors 52*a* and 52*b* be provided between free rollers that do not apply an external force to the web 20.

It is highly improbable that the web 20 will meander or that a wrinkle will be formed between such free rollers that do not apply an external force to the web 20. Therefore, the web width is detected at all times by the edge sensors 52*a* and 52*b* and the formation of a wrinkle in the web 20 is detected when the detected size of web width is below a predetermined threshold, thereby making it possible to detect at a low cost the formation of wrinkles generated when the web 20 is conveyed, without any effect from misalignment of rolls or transverse position correction control performed by the guide roller.

Figure 9:
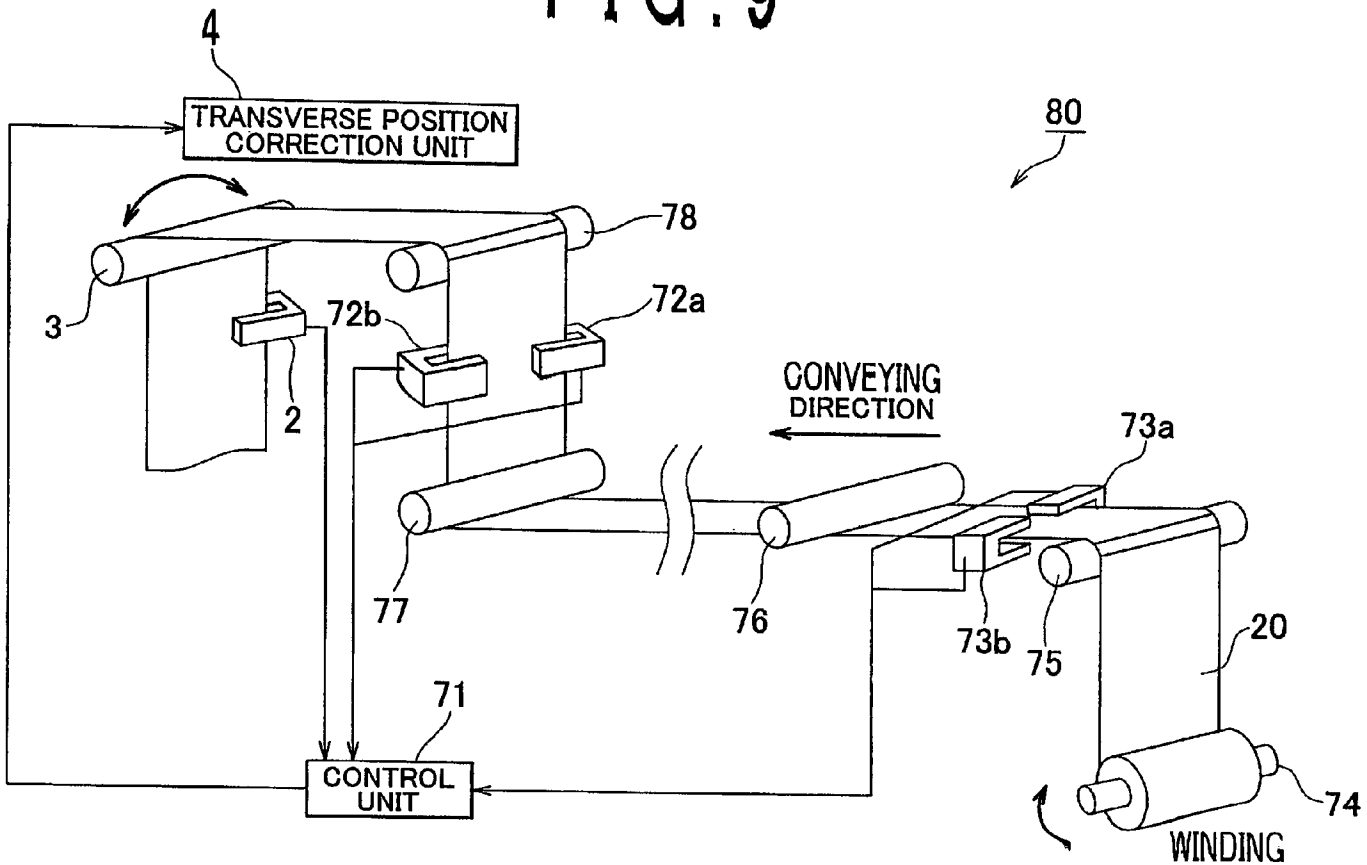
FIG. 9 illustrates the entire configuration of a web conveying apparatus of Embodiment 4 of the invention.

A configuration of the web conveying apparatus of Embodiment 4 of the invention will be described below with reference to FIG. 9. As shown in FIG. 9, a web conveying apparatus 80 has a control unit 71, an edge sensor 2, a guide roller 3, a transverse position correction device 4, edge sensors 72*a* and 72*b*, edge sensors 73*a* and 73*b*, free roller 74, free rollers 75 and 76, and free rollers 77 and 78. The web conveying apparatus 80 further includes a plurality of rollers and roller drive means as members necessary to convey a web 20 (these members are not shown in FIG. 9). The guide roller 3 and transverse position correction device 4 are structural elements and corresponding parts having configurations and functions identical to those described in Embodiment 1. Therefore, the explanation thereof is herein omitted.

The control unit 71 is a controller configured by a CPU, a ROM, a RAM, and the like. The control unit 71 inputs detection signals from the edge sensors 2, 72*a*, 72*b*, 73*a*, and 73*b*, and controls the drive of conveying rollers (not shown in the figure) or controls the transverse position correction device 4 and controls the guide roller 3.

The control unit 71 has a function of drive controlling the position of the guide roller 3 with the transverse position correction device 4, thereby shifting the web 20 in the transverse direction, so that the web 20 is disposed in a desired transverse position, on the basis of transverse position information or transverse position displacement information of the web 20 detected by the edge sensor 2.

In particular, the control unit 71 of Embodiment 4 has a function of calculating a high-frequency component included in a signal relating to transverse position information of the web 20 or width information of the web from detection signals of the edge sensors 72*a* and 72*b* or edge sensors 73*a* and 73*b* and acquiring a high-frequency undulation component in the web 20 by frequency analysis. The control unit 71 also has a function of acquiring transverse position information from which a high-frequency component has been removed by passing the transverse position information detected by the edge sensor 2 via a low-pass filter (filter that passes low frequencies) for removing the acquired high-frequency component. In addition, the control unit 71 is also provided with a function of executing transverse position control with the guide roller 3 on the basis of transverse position information from which the high-frequency component has been removed.

The edge sensor 2 functions as transverse position displacement detection means for detecting the transverse position of the conveyed web 20 and outputting the detection signal to the control unit 71. The edge sensor 2 of Embodiment 4 is provided downstream of the guide roller 3 and detects the transverse position of the web 20 after the transverse position thereof has been controlled by the guide roller 3. In FIG. 9, the edge sensor 2 is provided at one edge of the web 20, but such configuration is not limiting, and the edge sensor 2 may be also provided at both edges.

The edge sensors 72*a*, 72*b*, 73*a*, and 73*b* function as width detection means that detect the transverse position of the conveyed web 20 and output the detection signals to the control unit 71. The control unit 71 calculates the absolute value of the width in the left-right direction of the web 20 on the basis of the detection signals outputted by the edge sensors 72*a*, 72*b*, 73*a*, and 73*b* provided at the left and right edges of the web.

The edge sensors 72*a* and 72*b* of Embodiment 4 are provided between the free roller 77 and the free roller 78 and detect the transverse position of the web 20 immediately before the transverse position thereof is controlled by the guide roller 3. The edge sensors 73*a* and 73*b* of Embodiment 4 are provided between the free roller 75 and the free roller 76 and detect the transverse position of the web 20 immediately after the web 20 has been unwound from the free roller 74. In FIG. 9, two sets of edge sensors (edge sensors 72*a* and 72*b* and edge rollers 73*a* and 73*b*) are shown, but the invention may use at least one set of the two sets of edge sensors.

The edge sensors 72*a*, 72*b*, 73*a*, and 73*b* are preferably provided between free rollers that are not involved in the processing process and that are completely free of misalignment. For example, it is preferred that the edge sensors 72*a* and 72*b* be provided between free rollers 77 and 78 that are provided before a zone in which the transverse position correction is executed or that the edge sensors 73*a* and 73*b* be provided between the free rollers 75 and 76 provided in a zone immediately after unwinding in which the processing process is started. Furthermore, the free rollers are disposed so as to be maintained parallel to each other. Thus, it is preferred that the edge sensors 72*a*, 72*b*, 73*a*, and 73*b* be provided between free rollers that do not apply an external force to the web 20.

The aforementioned high-frequency component will be described below. Even if a case where the web 20 meanders is excluded, the edge of the web 20 is not necessarily in the form of a straight line. For example, the edge has high-frequency undulations due to burring occurring during slitting or because of curling occurring during rolling. Furthermore, even in a case where edge undulations are large, the detected signal becomes smaller as the conveying speed of the web 20 increases. Therefore, when a transverse position, is corrected based on the signal including such a high-frequency component, this component causes transient movement of the guide roller 3 and becomes a factor causing the formation of wrinkles in the web 20. Further, depending on product requirements, there can be cases in which it is not necessary to correct the transverse position to a level of undulations with a small amplitude caused by such high-frequency components. In other words, the high-frequency component in the embodiment is information that is not required to be taken into account in correcting the transverse position of the web 20.

Between free rollers where external force is not applied to the web 20, the meandering of the web 20 is very small and the formation of wrinkles is extremely rare. Therefore, where the edge sensors 72*a*, 72*b*, 73*a*, and 73*b* are provided between such free rollers, it is possible to determine the detected high-frequency component as a simple noise signal.

FIG. 10 is a schematic diagram explaining how the transverse position correction is performed based on the detected high-frequency component.

Figure 10A:
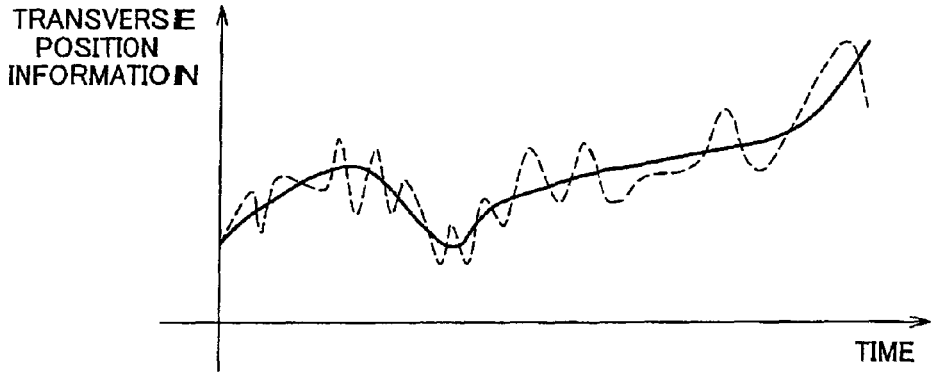
FIGS. 10A and 10B are schematic views illustrating a mode of web conveying control of Embodiment 4 of the invention.
Figure 10B:
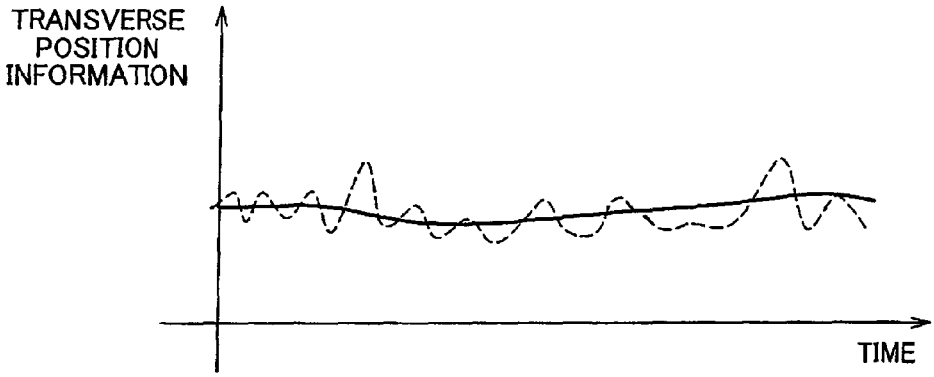
Figure 11:
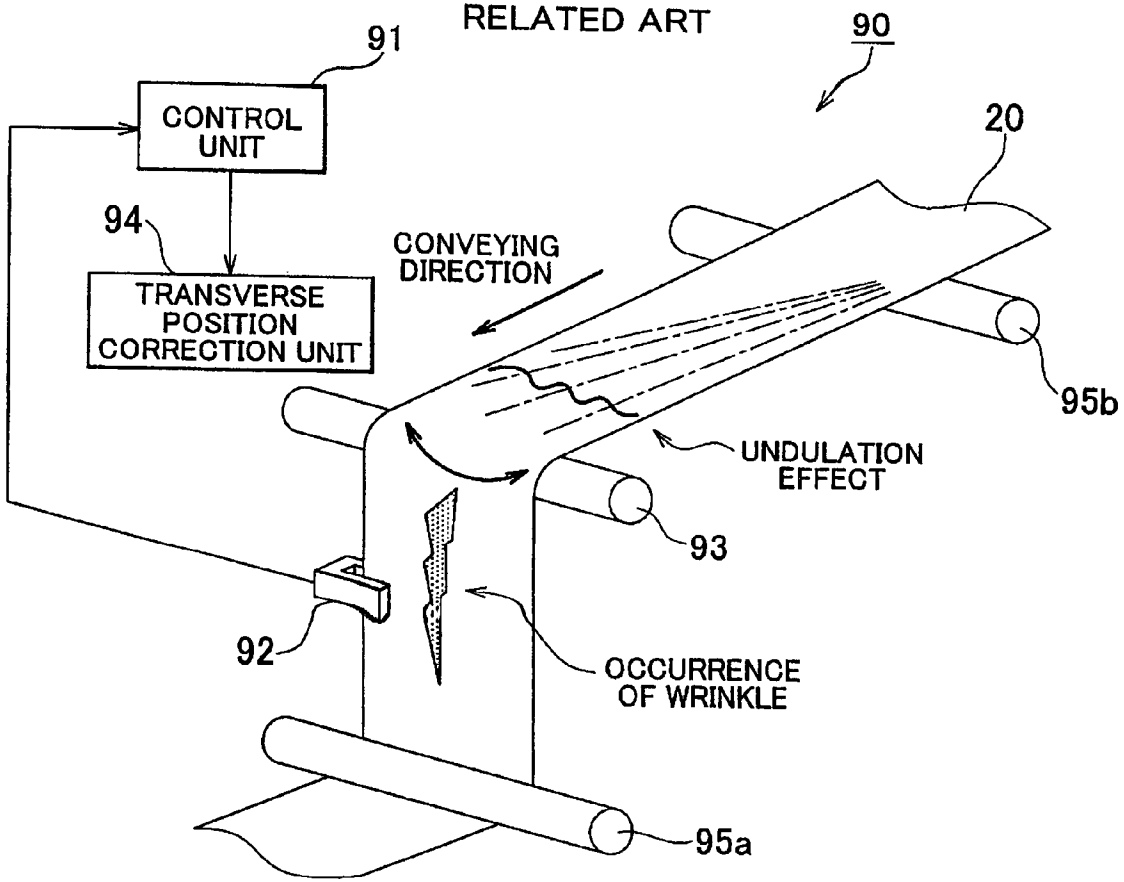
FIG. 11 RELATED ART
FIG. 11 illustrates the entire configuration of a web conveying apparatus of related art.

The control unit 71 calculates, a high-frequency component contained in a signal relating to transverse position information of the web 20 or width information of the web that is detected by the edge sensors 73*a* and 73*b* (or edge sensors 72*a* and 72*b*) and acquires a high-frequency undulation component of the web 20 by frequency analysis. Thus, a time contact of the low-pass filter for the detection signal is determined from the detection results of the edge sensors 73*a* and 73*b* (or edge sensors 72*a* and 72*b*). Then, the control unit 71 acquires transverse position information from which the high-frequency component has been removed (for example, as shown in FIG. 10A, the transverse position information shown by a broken line is corrected into the transverse position information shown by a solid line) by passing the transverse position information detected by the edge sensor 2 through the low-pass filter for removing the acquired high-frequency component (filter that passes low frequencies). In addition, the control unit 71 executes transverse position control with the guide roller 5 on the basis of transverse position information from which the high-frequency component has been removed (for example, as shown in FIG. 10B, the transverse position information shown by a broken line is corrected into the transverse position information shown by a solid line).

As described hereinabove, the transverse position information of the web 20 is detected at all times by the edge sensors 73*a* and 73*b* (or edge sensors 72*a* and 72*b*), a high-frequency component contained in the signal indicating the detected width size of the web 20 is detected, and a signal indicating the transverse position information detected by the edge sensor 2 is calculated by a low-pass filter processing that removes the detected high-frequency component, thereby making it possible to prevent transient movement of the web during conveying and inhibit the formation of wrinkles at a low cost.

While the invention has been described with reference to example embodiments thereof, it is to be understood that the invention is not limited to the described embodiments or constructions. To the contrary, the invention is intended to cover various modifications and equivalent arrangements. In addition, while the various elements of the disclosed invention are shown in various example combinations and configurations, other combinations and configurations, including more, less or only a single element, are also within the scope of the appended claims.

The invention claimed is:

1. A web conveying apparatus that conveys a web, comprising:

a transverse position displacement detection unit that detects a transverse position displacement of the web;

a transverse position correction unit that corrects a transverse position of the web by a guide roller;

a width detection unit that detects a width size in a left-right direction of the web; and a control unit programmed to determine a correction amount in a feedback control in accordance with the transverse position displacement detected by the transverse position displacement detection unit, wherein the control unit is programmed to respond to the web width size not being below a predetermined threshold and accordingly perform feedback control of the transverse position correction unit to adjust the guide roller by the correction amount to correct a position of the web, and wherein the control unit is further programmed to respond to the web width size being below the predetermined threshold and accordingly reduce the determined correction amount in the feedback control, and to perform the feedback control of the transverse position correction unit to adjust the guide roller by the reduced correction amount to correct the position of the web.

2. The web conveying apparatus according to claim 1, wherein the width detection unit is configured by two transverse position displacement detection units provided at left and right edges of the web.

3. The web conveying apparatus according to claim 1, wherein free rollers are provided respectively upstream and downstream of the guide roller, and the width detection unit is provided on a side of the guide roller where one of the free rollers is nearer to the guide roller.

4. A web conveying control method comprising:

detecting a transverse position displacement of a web;

detecting a width size in a left-right direction of the web;

calculating a correction amount for feedback controlling so that the web is positioned in a target position in accordance with the detected transverse position displacement;

comparing the detected web width size with a predetermined threshold;

responding to the web width size not being below the predetermined threshold and accordingly performing the feedback controlling that shifts the web in a transverse direction by adjusting a guide roller by the correction amount to correct a position of the web; and responding to the web width size being below the predetermined threshold and accordingly reducing the calculated correction amount for the feedback controlling, and performing the feedback control that shifts the web in the transverse direction by adjusting the guide roller by the reduced correction amount to correct the position of the web.

5. The web conveying control method according to claim 4 wherein, the width size in a left-right direction of the web is detected by detecting a transverse position displacement of left and right edges of the web.

6. The web conveying control method according to claim 4, wherein free rollers are provided respectively upstream and downstream of the guide roller, and the web width size is detected on a side of the guide roller where one of the free rollers is nearer to the guide roller.

* * * * *